United States Patent [19]

Schaeffer

[11] 4,429,560

[45] Feb. 7, 1984

[54] APPARATUS FOR MAKING A TRANSITION PLATE FOR A MINE ROOF TRUSS

[75] Inventor: Charles W. Schaeffer, Lebanon, Pa.

[73] Assignee: Bethlehem Steel Corporation, Bethlehem, Pa.

[21] Appl. No.: 323,322

[22] Filed: Nov. 19, 1981

[51] Int. Cl.[3] ..... B21D 28/14; B21D 28/26

[52] U.S. Cl. ..... 72/328; 72/326; 72/333; 72/339; 72/427

[58] Field of Search ..... 72/326–329, 72/332, 333, 335, 337–339, 379, 427; 29/150

[56] References Cited

U.S. PATENT DOCUMENTS

| | | | |
|---|---|---|---|
| 235,353 | 12/1880 | Geldreich | 72/328 |
| 595,107 | 12/1897 | Levedahl | 72/338 |
| 939,468 | 11/1909 | Boyce | 72/332 |
| 1,754,915 | 4/1930 | Therrien | 72/427 |
| 1,994,428 | 3/1935 | Keil | 72/379 |
| 2,264,520 | 12/1941 | Gleason | 29/150 |
| 3,436,947 | 4/1969 | Steppon | 72/339 |

*Primary Examiner*—Daniel C. Crane

*Attorney, Agent, or Firm*—John I. Iverson; John J. Selko

[57] ABSTRACT

Apparatus and method for making a transition plate for a mine roof truss from a strip of metal includes a die set having a first and second station. In the first station the strip of metal is bent downwardly at its sides, a notch is sheared in both sides of the strip and two holes are pierced through the strip. In the second station the transition plate is completed by bending the leading portion of the strip into an "M" shaped saddle portion, the strip is sheared transversely and bent downwardly at its trailing end.

1 Claim, 10 Drawing Figures

SECOND STATION 70
FIRST STATION 68

APPARATUS FOR MAKING A TRANSITION PLATE FOR A MINE ROOF TRUSS

BACKGROUND OF THE INVENTION

This invention relates generally to a method and apparatus for making a product from a strip of metal and more specifically to a method and apparatus for making a transition plate for a mine roof truss from a strip of metal in a die set which includes two stations.

Heretofore a transition plate for a mine roof truss was so shaped that it was either cast from metal, made of a number of individual parts or consisted of a limited number of simple bends.

SUMMARY OF INVENTION

It is an object of this invention to provide a method and apparatus for economically and efficiently producing a transition plate for a mine roof truss.

It is also an object of this invention to provide a method and apparatus which allows for the manufacture of a transition plate from a continuous strip of metal.

The above objects can be attained by this invention which is directed towards a method and apparatus for making a transition plate from a strip of metal by means of a die set having two stations. In one station the strip of metal is bent downwardly along its sides, notches are sheared in both sides of the strip and two holes are made in the strip. In the other station, making of a transition plate is completed by bending the leading portion of the strip into an "M" shaped saddle portion which extends across the width of the plate and is centered along the longitudinal axis of the plate, the strip is sheared transversely and is bent downwardly at its trailing end.

DETAILED DESCRIPTION OF THE DRAWINGS

Mine Roof Truss Transition Plate

Figure 1:
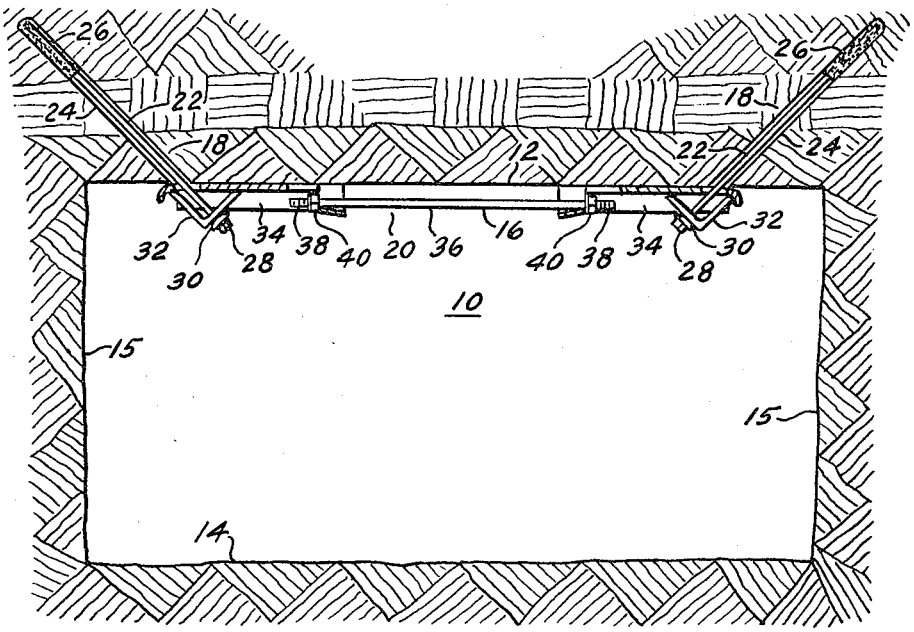
FIG. 1 is an elevation view of a mine roof truss including a transition plate made in accordance with the method and apparatus of this invention.

Referring to FIG. 1, the numeral 10 indicates an underground mine passageway having a roof 12, mine floor 14 and mine ribs 15. A mine roof truss 16 comprises two inclined chords 18 and a horizontal chord 20. Each inclined chord 18 comprises a mine roof bolt 22 having its upper end anchored in a hole 24 by resin 26. The lower end of the bolt 22 has a head portion 28 which is in contact with a spherical washer 30. Angle washer 32 is positioned under the head portion 28 of mine roof bolt 22 and in contact with spherical washer 30 and transition plate 34. The horizontal chord 20 comprises a tie member 36 having threaded portions 38 for engagement with nuts 40 to secure tie member 36 to transition plate 34.

Referring to FIGS. 2, 4, 5 and 6, transition plate 34 comprises a generally flat body 42 having a length greater than the width with a longitudinal axis 44. Face 46 of transition plate 34 has a generally planar surface adapted to bear and be closely against mine roof 12 of FIG. 1. The transition plate 34 has a pair of sides 48,50 which are bent at right angles to face 46. The transition plate 34 has a pair of ends 52,54. A pair of notches 56,58 are provided adjacent end 52 and in the corners of transition plate 34. End 52 is bent at a right angle to face 46.

Figure 2:
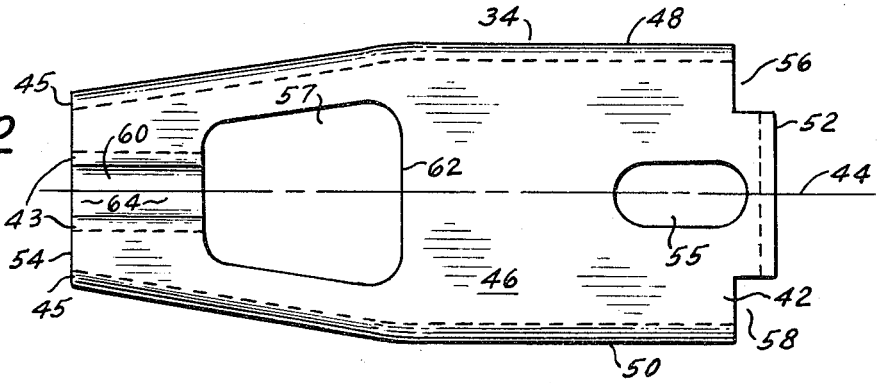
FIG. 2 is a plan view of the transition plate.

As best shown in FIG. 2, transition plate 34 has a first elliptical opening 55 in body 42 adjacent end 52 with the long axis of the opening 55 coinciding with longitudinal axis 44. A second larger opening 57 is also provided in body 42 adjacent the other end 54 of transition plate 34.

Figures 4, 5, 6, 10:
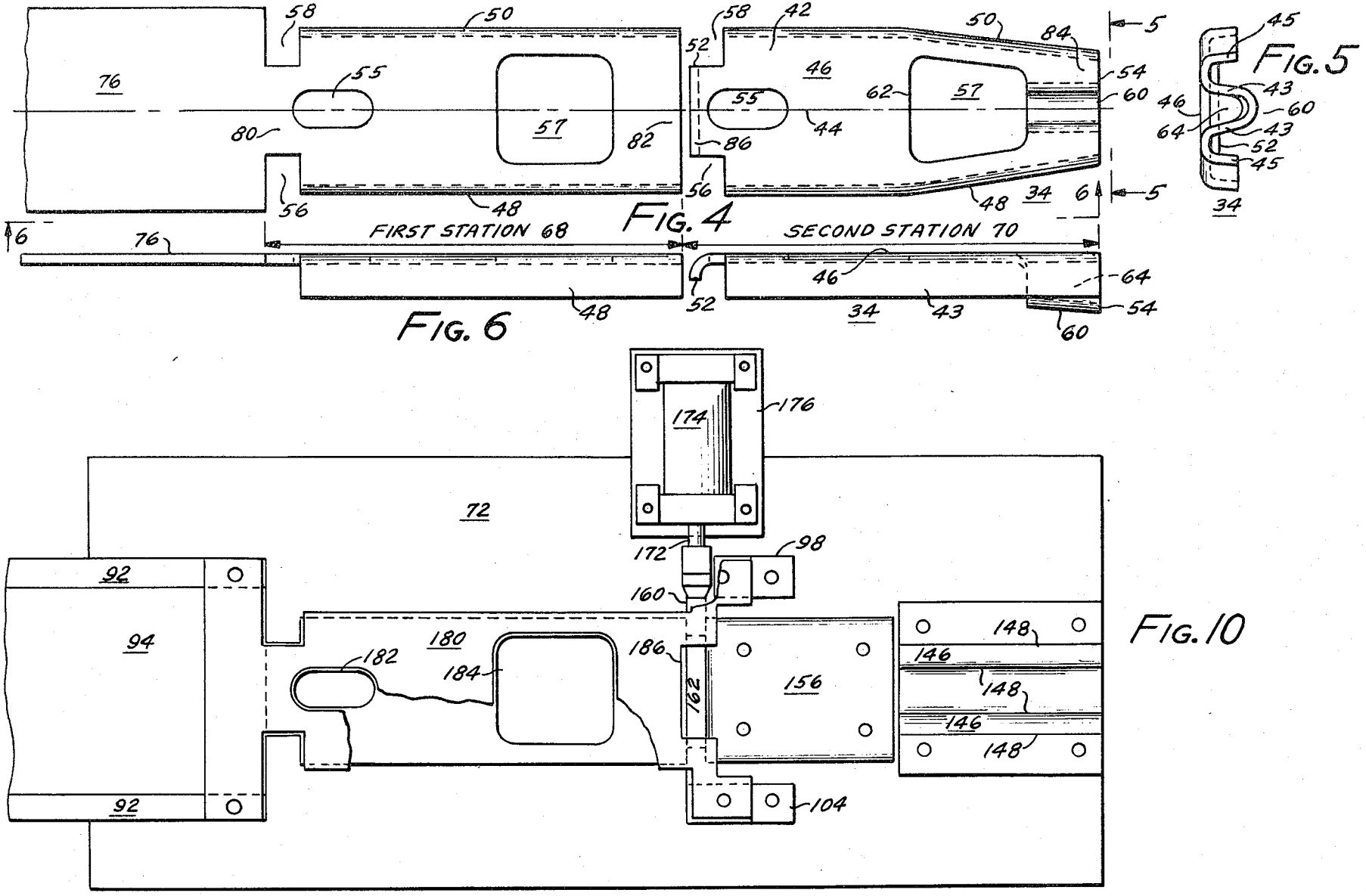
FIG. 4 is a plan view of the strip at the various stations.
FIG. 5 is a view taken along lines 5—5 of FIG. 4.
FIG. 6 is a view taken along lines 6—6 of FIG. 4.
FIG. 10 is a view taken along lines 10—10 of FIG. 3.

As best shown in FIGS. 2, 5 and 6, an elongated saddle portion 60 extends outwardly from face 46 and is centered about longitudinal axis 44. In forming saddle portion 60 the sides 48,50 are pulled towards each other beginning at the innermost end 62 of opening 57. Saddle portion 60 is "M" shaped with the inner two legs 43 of the "M" extending beyond the outer two legs 45. Saddle portion 60 extends from end 54 to opening 57 and forms a groove or tunnel-like opening 64.

Method

Referring to FIGS. 3, 4, 5 and 6, the method of this invention is directed towards making a transition plate 34 in a die set generally indicated by the numeral 66 and having a first station 68 and a second station 70. The die set is of a type well known in the art with the lower tools fixed to the bed plate 69 of a vertical press by means of a lower mounting plate 72 and the upper tools fixed to the movable crosshead plate 67 of the press by means of an upper die block 73 and an upper mounting plate 74. Thus the upper die block 73 and upper mounting plate 74 and the tools attached thereto are movable toward and away from the lower mounting plate 72 and its tools. A strip of metal 76 is fed between the upper and lower tools along the line 78. The lower tools support the strip 76 and the upper tools cooperate with the lower tools to shape the strip into a transition plate 34.

While the die set of this invention is described as mounted on a vertical press with the upper mounting plate 74 and upper die block 73 movable with respect to the lower mounting plate 72, it is obvious that the die set could be mounted on any type press and the lower mounting plate 72 could be adapted to move relative to the upper mounting plate 74 and upper die block 73.

U.S. Pat. No. 1,632,462 to Candee discloses a power press which could be used to produce the desired movement between the upper and lower tools. To the extent that the means to produce such movement is necessary for a complete disclosure of this invention, the disclosure of the above patent to Candee is hereby incorporated by reference.

Referring to FIGS. 4 and 6 the method of this invention comprises feeding a strip of metal 76 into the first station 68 of a die set. In the first station the following operations are substantially simultaneously performed on the portion of the strip of metal 76 positioned in the first station 68. The sides 48,50 of the strip 76 are bent downwardly at substantially a right angle to the plane of the strip 76. Notches 56,58 are sheared in the trailing portion 80 of the strip 76 in the first station 68. Openings 55 and 57 are punched through the strip 76. Opening 55 is adjacent the trailing portion 80 of the strip 76 in first station 68, and opening 57 is adjacent the leading portion 82 of the strip 76 in first station 68.

Next the strip is fed or indexed from the first station 68 to the second station 70. While the strip is in the second station 70 the following operations are substantially simultaneously performed on the strip 76. In addition while the second station operations are being performed on the strip 76, the operations described above for the first station 68 are also being performed on the strip 76.

In the second station 70, the leading portion 84 of the strip 76 is bent into a substantially "M" shape, as best shown in FIG. 5. The strip 76 is sheared transversely at the trailing end portion 86 of the strip 76 in the second station 70. The trailing end 52 is bent downwardly at substantially a right angle to the plane of the strip 76. Thereafter the trailing end 52 is raised relative to the lower tools to facilitate discharging the formed transition plate 34 from the second station 70.

Apparatus

Figure 3:
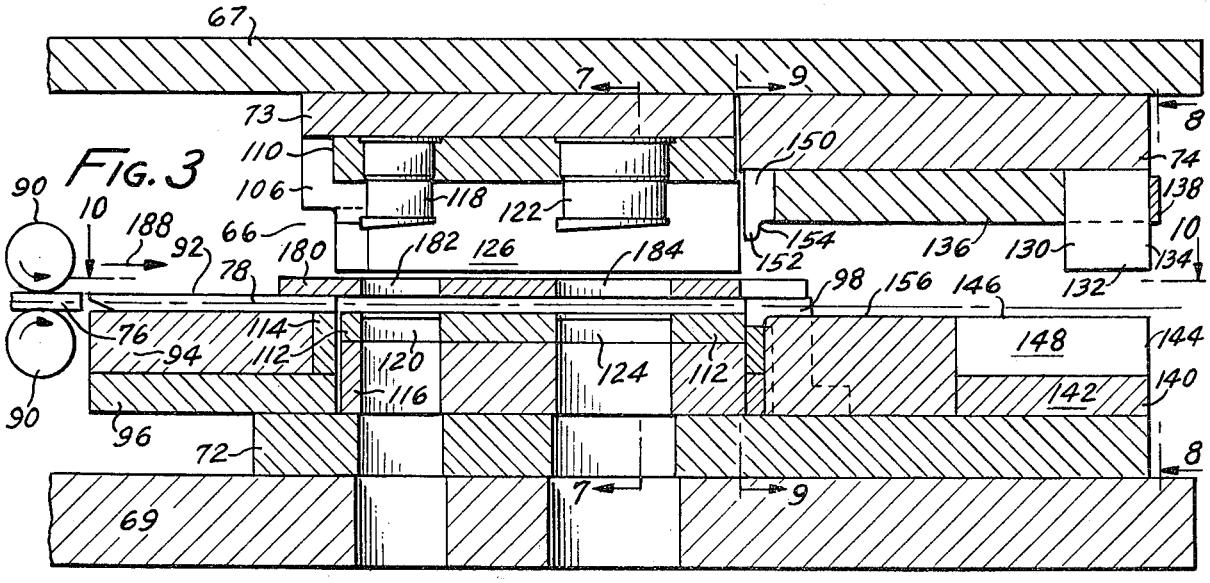
FIG. 3 is a longitudinal sectional view of the apparatus of this invention.

FIG. 3 shows die set 66 in the open position, i.e. the upper tools have moved upwardly to their highest position. Line 78 indicates the approximate centerline of the strip 76 as it is fed between the tools of the die set 66. Rollers 90 intermittently feed the strip 76 between the upper and lower tools along line 78 in a manner well known in the art. In addition guides 92 aid in properly positioning the strip 76 with respect to the tools. Guides 92 extend along both sides of the strip 76 and are mounted on stock guide holder 94 which is attached to stock guide holder liner 96. Stock guide holder liner 96 is secured to lower mounting plate 72.

First Station

Figure 9:
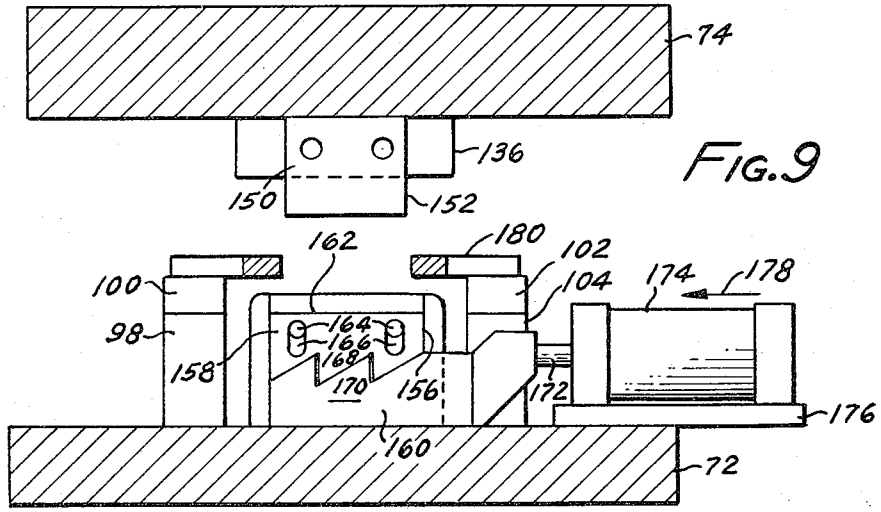
FIG. 9 is a view taken along lines 9—9 of FIG. 3.

The strip 76 is fed into the first station 68 by feed rolls 90 until the right and left corners of the leading end of strip 76 contacts the ends of right and left stripper plate supports 104,98. Left stripper plate support 98 is best seen in FIG. 3. Referring to FIG. 9, the vertically extending surface 100 of the left stripper plate support 98 and the vertically extending surface 102 of right stripper plate support 104 act as stops and contact the leading end of strip 76 to position the strip 76 properly in first station 68.

Figure 7:
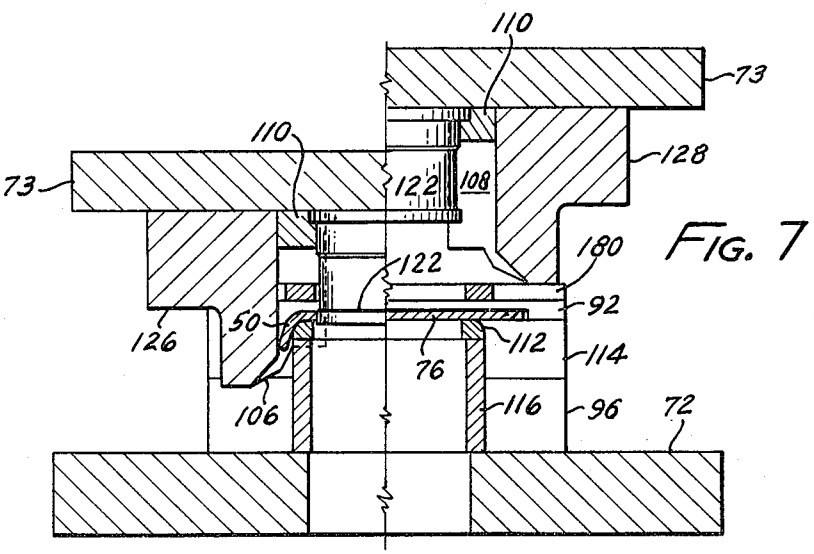
FIG. 7 is a view taken along lines 7—7 of FIG. 3 with the right half showing the upper tools at their highest point and the left half showing the upper tools at their lowest point.

Referring to FIGS. 3, 4 and 7, the tools of the first station 68 shear notches 56,58 on the sides 48,50, respectively, of the strip; 76, pierce holes 55,57 in the strip 76 at the trailing and leading portions 80,82, respectively; and bend the sides 48,50 downwardly at right angles to the horizontal plane in which the strip 76 lies.

Referring to FIG. 7, it will be noted that the left half of FIG. 7 shows the upper tools at their lowest position relative to the lower tools, while the right half of FIG. 7 shows the upper tools at their highest position relative to the lower tools.

Referring to FIG. 4, the notches 56,58 are sheared in the sides 48,50, respectively, by upper and lower tools. As best shown in FIG. 7, the upper tools include two shear knives, a left shear knife 106 and a right shear knife 108 which is attached to holder 110 which bears against and is secured to upper die block 73. As best shown in FIG. 7, the lower tools include a forming die 112 which includes a notch at both its sides to accept the shear knives 106,108. In addition lower shear knife 114 cooperates with knives 106,108 to shear notches 56,58 in the strip 76. Forming die 112 is mounted on lower die block 116 which is secured to lower mounting plate 72. Lower shear knife 114 is mounted on stock guide holder liner 96 which is secured to lower mounting plate 72.

Referring to FIGS. 3 and 4, the holes 55,57 in the trailing 80 and leading 82 portions, respectively, of the strip 76, are made by upper and lower tools. The upper tool which makes elliptical hole 55 is a piercing punch 118 which is mounted in holder 110 which is secured to upper die block 73. The lower tool for making hole 55 is the forming die 112 which includes a hole 120 which is in vertical alignment with punch 118 and shaped to produce the elliptical hole 55. The upper tool which makes hole 57 is a piercing punch 122 also mounted in holder 110. The lower tool for making hole 57 is forming die 112 having a hole 124 which is in vertical alignment with punch 122 and shaped to produce the rectangular hole 57. Lower die block 116, lower mounting plate 72, bed plate 69, all have openings which correspond and are aligned with openings 120,124 in forming die 112 in order to allow the material pierced from strip 76 to pass downwardly and be removed from the die set 66.

Referring to FIGS. 4, 6 and 7, the sides 48,50 of the strip 76 are bent downwardly by the cooperation of upper and lower tools in the first station. The upper tools include a pair of bending tools 126,128 which contact the upper surface of the sides 48,50 and bend the sides 48,50 about forming die 112 such that the sides 48,50 extend downwardly at substantially a right angle to the plane of strip 76. The bending tools 126,128 are secured to upper die block 73.

Second Station

After the operation of notching, piercing and bending described above are performed in the first station 68, the strip 76 is fed into the second station 70 by feed rolls 90. As described above the strip 76 is moved until the right and left corners of the strip 76 contacts the vertically extending surface 100 of the left stripper plate support 98 and the vertically extending surface 102 of right stripper plate support 104, respectively. This movement properly positions the strip 76 in both the first and second stations, 68,70 respectively.

Referring to FIG. 4, while in the second station 70 the leading portion 84 of the strip 76 is bent into a substantially "M" shape to form a saddle portion 60, the trailing end portion 86 of the strip 76 is sheared transverse to the longitudinal axis 44, the trailing end 52 is bent downwardly at substantially a right angle to the plane of the strip 76, the trailing end 52 of the strip 76 is lifted prior to removing a finished transition plate 34 from the second station 70.

As best shown in FIGS. 3, 4, 5, 6 and 8, the saddle portion 60 is formed by cooperating aligned upper and lower tools. The upper tools include a saddle forming punch 130 which has a semi-circular lower portion 132 and a pair of vertically extending parallel side walls 134. The saddle forming punch 130 is secured to upper mounting plate 74. In addition, saddle forming punch 130 is positioned in a slot in intermediate die block 136 and held within the slot by means of saddle forming punch clamp 138 which is attached to intermediate die block 136.

Figure 8:
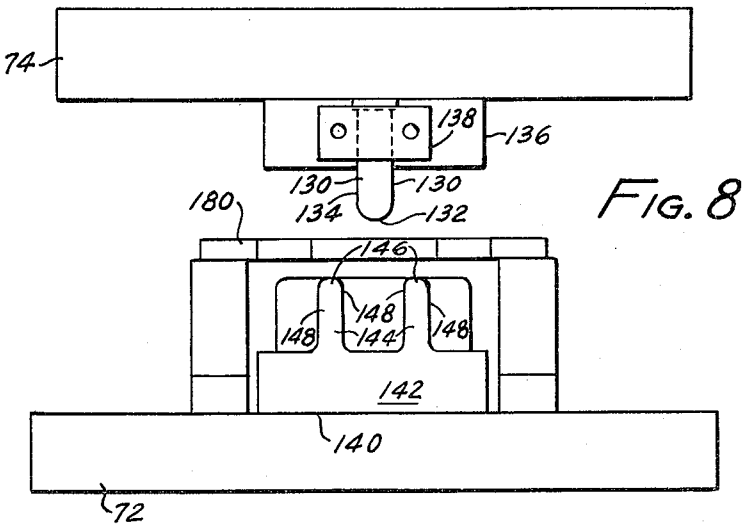
FIG. 8 is a view taken along lines 8—8 of FIG. 3.

Referring to FIGS. 3 and 8 the lower tool which cooperates and is aligned with saddle forming punch 130 is saddle forming die 140. Saddle forming die 140 is secured to lower mounting plate 72. Saddle forming die 140 includes a lower base 142 and a pair of upstanding leg members 144 which have upper semi-circular portions 146 and vertically extending, parallel wide walls 148. Saddle forming die 140 cooperates with saddle forming punch 130 to form "M" shaped saddle portion 60 of the transition plate 34.

As best shown in FIGS. 3, 6 and 9 the trailing end portion 86 of the strip 76 in the second station 70 is sheared by cooperating and aligned upper and lower tools. The strip is sheared at the trailing end of notches 56,58. The upper tool includes a combination shear and bend tool 150 which bears against upper mounting plate 74, is attached to intermediate die block 136, and extends transverse to the feed line 78 of the strip 76. As best shown in FIG. 3 the tool includes a downwardly extending portion 152 which contacts the strip 76 and cooperates with the end of forming die 112 to shear the strip 76. Forming die 112 acts on the lower tool to shear the strip 76.

As best shown in FIGS. 3 and 6 the trailing end 52 of the strip 76 is bent downwardly at substantially a right angle to the plane of the strip 76 by upper and lower tools. The upper tool includes the combination shear and bend tool 150. The downwardly extending portion 152 of tool 150 includes an arcuate portion 154 that assists in bending the strip 76 about the lower tool which comprises lower die block 156. Lower die block 156 is attached to lower mounting plate 72.

As best shown in FIGS. 6, 9 and 10 the trailing portion 86 of formed transition plate 34 in the second station 70, i.e. the plate 34 after the upper and lower tools of the second station 70 form the saddle portion 60, shear the strip 76 and bend the trailing end 52 downwardly, is lifted or raised by a lifting arrangement. Referring to FIG. 9, the lifting arrangement includes upper lifting arm 158 and lower lifting arm 160. Upper lifting arm 158 has an upper surface 162 which is positioned below the bent end 52 of the plate 34. Upper lifting arm 158 is slidably secured to lower die block 156 by fastening means 164 which extend through slots 166 in upper lifting arm 158. The lower portion of upper lifting arm 158 comprises a saw tooth portion 168. Lower lifting arm 160 includes on its upper portion a saw tooth portion 170 which mates with saw tooth portion 168 of upper lifting arm 158. The mating saw tooth portions 168,170 act as cams to raise and lower upper lifting arm 158. As best shown in FIGS. 9 and 10, lower lifting arm 160 is attached to piston rod 172 of cylinder 174 which is secured to cylinder mounting plate 176 by suitable fasteners. Cylinder mounting plate 176 is attached to lower mounting plate 72. Thus piston rod 172 is operable by cylinder 174 to move lower lifting arm 160 in the direction of arrow 178 of FIG. 9. By so moving lower lifting arm 160, upper lifting arm 158 is moved upwardly by the interaction of saw tooth portions 170,168 of lower lifting arm 160 and upper lifting arm 158, respectively. As upper lifting arm 158 moves upwardly the top surface 162 of the upper lifting arm 158 contacts the lower surface of bent end 52. In so doing the end of the transition plate 34 moves upwardly a sufficient distance such that when the transition plate 34 is moved horizontally, by contacting the end of the strip 76 being moved from the first station 68 to the second station 70 the lower end of the bent end 52 clears the top of lower die block 156 so that the transition plate 34 can be discharged from the second station 70.

Referring to FIGS. 3 and 10, a stripper plate 180 is provided and spaced above the top surface of forming die 112. The stripper plate 180 includes openings 182,184 to allow piercing punch 118 and piercing punch 122 to pass through the stripper plate 180. Fasteners secure one end of the stripper plate 180 to stripper plate supports 98,104 and the other end of stripper plate 180 to stock guides 92 and stock guide holder 94. The stripper plate 180 is spaced a sufficient distance about the forming die 112 to allow the strip 76 to pass freely between the stripper plate 180 and the forming die 112. The stripper plate 180 acts as a means to strip the upper tools of the first station 68 from the strip 76 after the bending, notching and piercing operations of the first station 68 has taken place. In addition, the stripper plate 180 has its end which is adjacent stripper plate supports 98,104 extending into the second station 70. Stripper plate 180 includes a cut out 186 to allow combination bending and shearing tool 150 to pass by the stripper plate 180 and shear and bend the strip 76 in the second station 70. After such shearing and bending, the stripper plate 180 is so positioned to strip the finished transition plate 34 from the combination shearing and bending tool 150 if the plate 34 is inclined to move upwardly with such tool.

SEQUENCE OF OPERATION

During the following sequence of operation, the lower mounting plate 72 and its tools remain stationary and the upper mounting plate 74 and upper die block 73 move between a first position, hereinafter called position A, i.e. the upper mounting plate 74 and upper die block 73 are raised so as that the lower ends of the upper tools are positioned as shown in FIG. 3 and a second position, hereinafter called position B, i.e. the upper mounting plate 74 and upper die block 73 are lowered to its lowest position and the lower ends of the upper tools are at their lowest point, e.g. as shown to the left half of FIG. 7.

First Step. With the upper tools in position A, a strip of metal 76 is fed by feed rolls 90 between strip guides 92 in the direction of arrow 188 in FIG. 3. The strip 76 passes under stripper plate 180 and rests on the lower tooling attached to lower mounting plate 72 including strip guide holder 94, lower shear knife 114 and forming die 112. The feed rolls 90 move the strip 76 until the leading end of the strip 76 contacts the vertical surfaces 100,102 of stripper plate supports 98,104. When such contact is made the strip 76 stops its movement and is properly positioned in the first station 68.

Second Step. The upper tools are then moved from position A to position B. In so doing the left and right shear knives 106,108 cooperate with notches in the forming die 112 to shear notches 56,58 in the strip 76. The piercing punches 118,122 cooperate with holes 120,124 in forming die 112 to shear openings 55,57 in the strip 76. The bending tools 126,128 cooperate with forming die 112 to bend the sides 48,50 of the strip 76 downwardly.

Third Step. With the upper tools returned to position A, the strip 76 is fed by feed rolls 90 in the direction of arrow 188 in FIG. 3 until the ends of the strip 76 again contact the vertical surfaces 100,102 of stripper plate supports 98,104. When such contact is made the strip 76 stops its movement and the strip 76 is properly positioned in the first station 68 and the second station 70.

Fourth Step. The upper tools are then moved from position A to position B. In so doing the operations of notching, piercing and bending referred to above under the Second Step are performed by the tools in the first station 68. In addition, in the second station 70 saddle forming punch 130 cooperates with the saddle forming die 140 to bend the leading end portion 84 of the strip into a saddle portion 60 having the shape of an "M". The trailing end portion 86 of the strip 76 is sheared by the cooperation of the combination shear and bend tool 150 and the end of forming die 112. The trailing end 52 of the strip 76 is bent such that it extends downwardly and transversely to the longitudinal axis 44 of the strip 76.

Fifth Step. With the upper tools returned (or while returning) to position A, the piston of cylinder 174 is moved in the direction of the arrow 178 in FIG. 9. This movement causes the piston rod 172 which is attached to lower lifting arm 160 to also move in that direction thereby causing the mating saw tooth portions 170 and 168 of lower lifting arm 160 and upper lifting arm 158 to act as cams to lift the upper lifting arm 158. By so doing, the top surface 162 of the upper lifting arm 158 contacts the lower surface of the end 52 of the transition plate 34 and raises the transition plate 34 so that it clears the top of lower die block 156.

Sixth Step. The Third Step set forth above is repeated and in so doing the strip 76 as it moves from the first to the second station ejects the finished transition plate 34 from the second station 70.

Although I have described my invention hereinabove in considerable detail, I do not wish to be limited narrowly to the exact and specific particulars disclosed, but I may also use equivalents, modifications and substitutes as are included within the scope and spirit of the invention.

I claim:

1. Apparatus for making a transition plate for a mine roof truss from a strip of metal comprising (1) a die set having first and second stations and means to initially feed and position said strip in said first station and thereafter feed and position said strip in said second station, (2) said first station including (a) means to bend the sides of said strip downwardly at substantially a right angle to the plane of said strip, (b) means to shear a notch in both sides of the trailing portion of said strip, and (c) means to pierce a first hole adjacent the leading portion of said strip and a second hole adjacent the trailing portion of said strip, (3) said second station including (a) means to bend the leading portion of said strip into a substantially "M" shape, (b) means to shear said strip transversely at the trailing portion of said strip adjacent said notches, and (c) means to bend the trailing portion of said strip adjacent said notches downwardly at substantially a right angle to the plane of said strip, (4) stripper plate means in said first station for stripping said bending means, said shearing means, and said piercing means of said first station from said strip, (5) stripper plate means in said second station for stripping said bending means and said shearing means of said second station from said strip, and (6) means directly below said trailing end strip shearing means to lift the trailing portion of said strip in said second station upwardly in an inclined position prior to removing said strip from said second station.

* * * * *